US008915296B2

(12) United States Patent
McGarian

(10) Patent No.: US 8,915,296 B2
(45) Date of Patent: Dec. 23, 2014

(54) APPARATUS AND METHOD FOR SETTING A TOOL IN A BOREHOLE

(76) Inventor: Bruce McGarian, Stonehaven (GB)

( * ) Notice: Subject to any disclaimer, the term of this patent is extended or adjusted under 35 U.S.C. 154(b) by 591 days.

(21) Appl. No.: 13/144,208

(22) PCT Filed: Jan. 8, 2010

(86) PCT No.: PCT/GB2010/050025

§ 371 (c)(1),
(2), (4) Date: Aug. 3, 2011

(87) PCT Pub. No.: WO2010/086634

PCT Pub. Date: Aug. 5, 2010

(65) Prior Publication Data

US 2011/0277998 A1 Nov. 17, 2011

(30) Foreign Application Priority Data

Jan. 27, 2009 (GB) ..... 0901282.4

(51) Int. Cl.
*E21B 47/00* (2012.01)
*E21B 7/06* (2006.01)
*E21B 29/06* (2006.01)

(52) U.S. Cl.
CPC . *E21B 7/061* (2013.01); *E21B 7/06* (2013.01); *E21B 29/06* (2013.01)
USPC ..... 166/255.3; 166/140; 166/117.6; 166/255.1

(58) Field of Classification Search
CPC ..... E21B 7/06; E21B 7/061; E21B 23/01; E21B 33/12; E21B 47/024; E21B 33/134
USPC ..... 166/255.3, 117.6, 135, 255.1, 140
See application file for complete search history.

(56) References Cited

U.S. PATENT DOCUMENTS 1,491,986 A 4/1924 Greene
2,158,356 A 5/1939 Dyer (Continued)

FOREIGN PATENT DOCUMENTS

EP 0685628 12/1995
EP 1222357 4/2004

(Continued)

OTHER PUBLICATIONS

UK Search report, Corresponding App. GB 0901282.4; 1 page; May 21, 2009.

(Continued)

*Primary Examiner* — Yong-Suk (Philip) Ro
(74) *Attorney, Agent, or Firm* — Hancock Hughey LLP

(57) ABSTRACT

Disclosed is an apparatus for setting an anchor in a borehole and milling a window in a side surface of the borehole in a single trip. The apparatus includes a mechanically-settable anchor initially forming part of the drill string, a plug member position below the anchor, and a milling assembly. When the drill string reaches a desired depth in the wellbore, the plug member may be activated from the surface, thus setting the plug member in position with respect to the wellbore. The anchor has an activation element which, when contacted in a predetermined manner, sets the anchor. The plug member has an operation element adapted so that, when the anchor and plug member come into contact with one another in a predetermined orientation, the activation element is operated by the operation element, thus setting the anchor.

20 Claims, 2 Drawing Sheets

(56) References Cited

U.S. PATENT DOCUMENTS

Figures 3A, 3B, 3C, 3D:
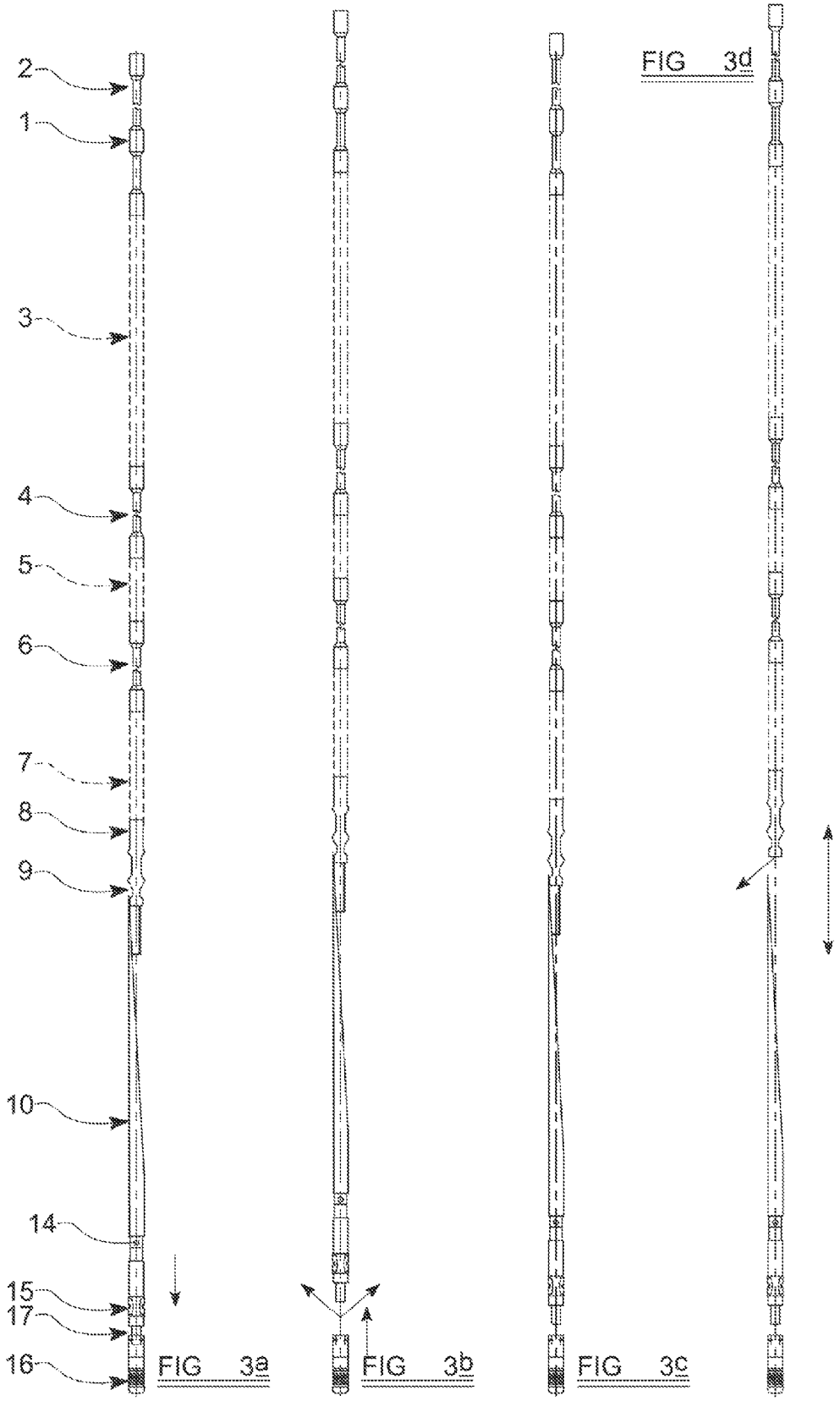

| | | | | |
|---|---|---|---|---|
| 4,397,355 | A | 8/1983 | McLamore | |
| 5,109,924 | A | 5/1992 | Jurgens | |
| 5,425,419 | A | 6/1995 | Sieber | |
| 5,445,222 | A | 8/1995 | Pritchard | |
| 5,553,671 | A * | 9/1996 | Sieber | 166/381 |
| 5,771,972 | A | 6/1998 | Dewey | |
| 5,826,651 | A | 10/1998 | Lee | |
| 5,894,889 | A | 4/1999 | Dewey | |
| RE36,526 | E | 1/2000 | Braddick | |
| 6,102,123 | A | 8/2000 | Bailey | |
| 7,455,118 | B2 * | 11/2008 | Roberts et al. | 166/387 |
| 2004/0089443 | A1 | 5/2004 | Dewey | |
| 2006/0249310 | A1 | 11/2006 | Stowe | |
| 2010/0012322 | A1 | 1/2010 | McGarian | |

FOREIGN PATENT DOCUMENTS

| | | | |
|---|---|---|---|
| GB | 2291448 | | 1/1996 |
| GB | 2315506 | | 2/1998 |
| GB | 2345934 | | 7/2000 |
| GB | 2348898 | | 10/2000 |
| GB | 2348660 | B | 11/2000 |
| GB | 2420359 | | 5/2006 |
| WO | 97/10409 | | 3/1997 |
| WO | 2005019596 | | 3/2005 |
| WO | 2006070204 | | 7/2006 |

OTHER PUBLICATIONS

UK Further Search report, Corresponding App. GB 0901282.4; 2 pages Jun. 8, 2010.

* cited by examiner

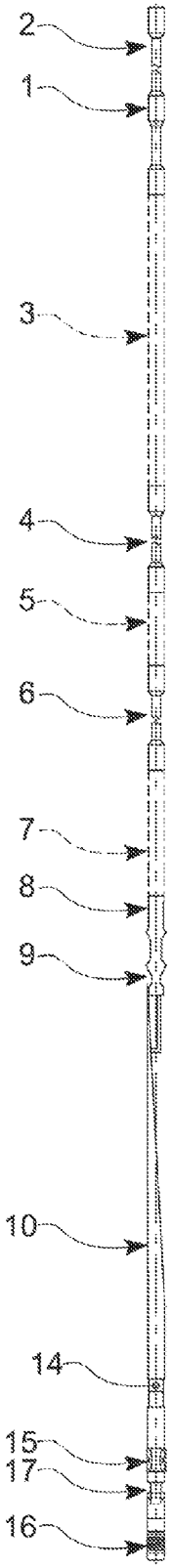
FIG 1
FIG 2
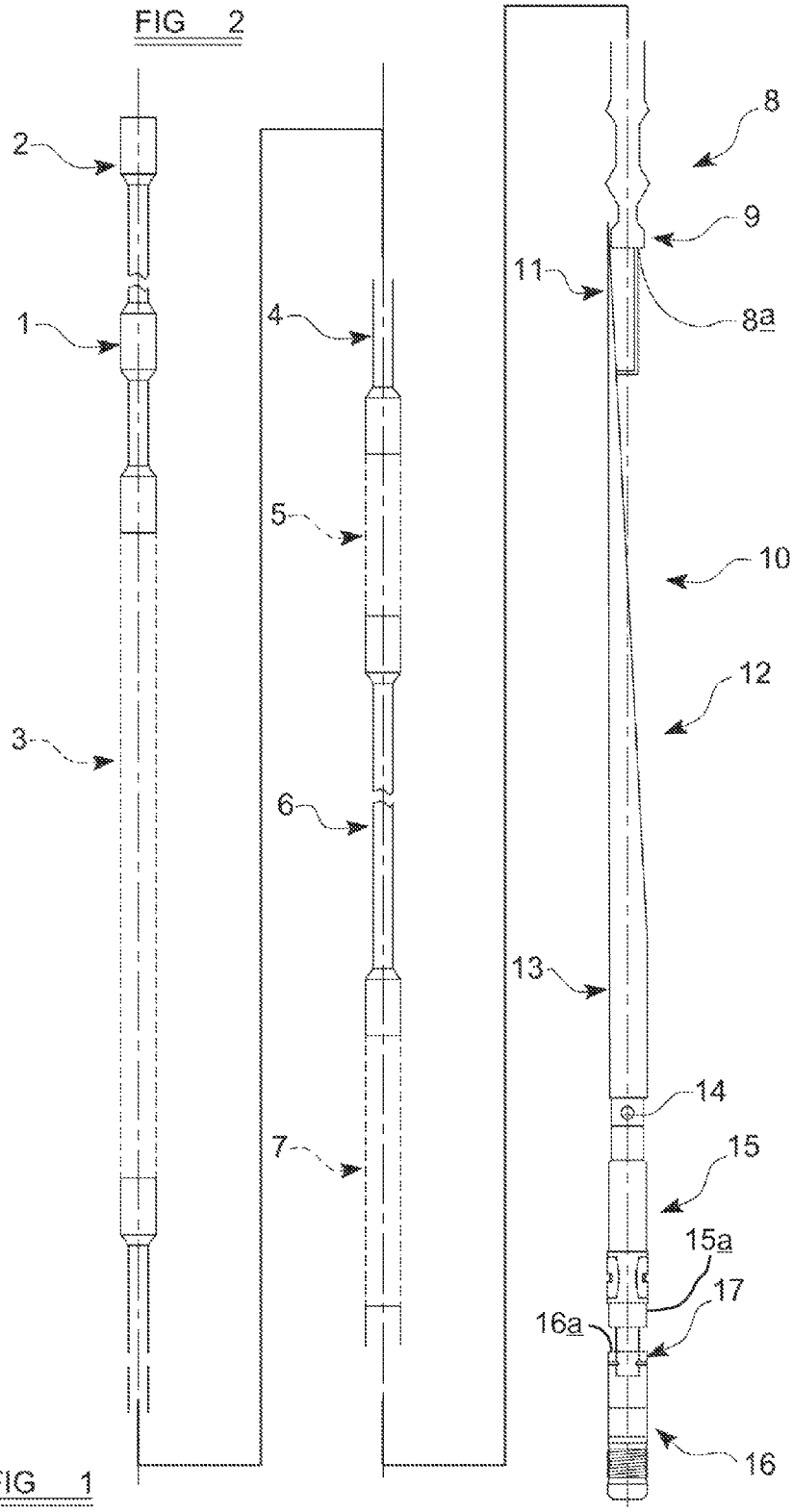

2
1
3
4
5
6
7
8
9
10
14
15
17
16

APPARATUS AND METHOD FOR SETTING A TOOL IN A BOREHOLE

DESCRIPTION OF INVENTION

THIS INVENTION relates to an apparatus and method for setting a tool in a borehole, and in particular concerns a system which may be used to set and orient a whipstock in a borehole, and mill a window in the casing of the borehole, in a single trip.

Several different approaches for orienting and setting a whipstock in a borehole have been proposed. For instance, GB2291448 discloses a system comprising a drill string having a "measurement-while-drilling" (MWD) tool, a bypass valve, a milling head, a whipstock and a hydraulically-set anchor or packer.

In use of the system, the drill string is run into a borehole until it reaches a required depth. Drilling fluid is then pumped into the drill string. At this point the bypass valve is in an open configuration, and allows the drilling fluid to circulate through appropriate ports, which may for instance be provided in the body of the valve. This circulation of drilling fluid through the drill string allows the MWD tool to measure the orientation of the drill string, and this allows operators of the system at the surface to determine that the whipstock is oriented in the correct direction.

At this point, the flow rate at which the drilling fluid is pumped into the drill string is increased. The effect of this is to close the bypass valve, which diverts fluid from the ports to the anchor/packer, thus hydraulically setting the anchor/packer. The whipstock is connected to the anchor/packer, and the whipstock is therefore secured in place in the borehole at a known depth and orientation.

The milling arrangement can then be detached from the whipstock, for instance by applying an upward force to the drill string to break one or more shear bolts. The milling head can then be activated, and a downward force applied to the drill string, to initiate the milling of a window in the casing of the borehole.

Once milling (and drilling or partial drilling of the new bore, if required) is complete, the whipstock and anchor/packer can be retrieved, and a skilled person will be aware of methods by which this can be achieved.

It is an object of the present invention to provide an improved system for milling a window in the casing of a borehole.

Accordingly, one aspect of the present invention provides an apparatus for setting an anchor in a borehole and milling a window in a side surface of the borehole in a single trip, comprising: a drill string; a mechanically-settable anchor initially forming part of the drill string; a plug member position below the anchor; and a milling assembly; wherein: when the drill string reaches a desired depth in the wellbore, the plug member may be activated from the surface, thus setting the plug member in position with respect to the wellbore; the anchor has an activation element which, when contacted in a predetermined manner, sets the anchor; and the plug member has an operation element adapted so that, when the anchor and plug member come into contact with one another in a predetermined orientation, the activation element is operated by the operation element, thus setting the anchor.

Advantageously, the bridge plug is hydraulically-settable.

Preferably, the drill string has a fluid path passing at least part of the way therealong, the bridge plug is in communication with the fluid path, and fluid may be pumped through the drill string to the plug member to activate the plug member.

Conveniently, the drill string further comprises: a measurement while drilling (MWD) tool; and a running tool which prevents fluid flow therethrough until the pressure in the fluid path exceeds a threshold, and wherein: the pressure required to set the plug member hydraulically is less than the threshold; and when the pressure in the fluid path exceeds the threshold, the running tool allows fluid to pass therethrough, thus allowing fluid to circulate through the MWD tool.

Advantageously, the apparatus further comprises one or more circulation ports provided on a component of the drill string, and wherein an isolation arrangement is provided to isolate the circulation ports from the fluid path until after the plug member has been hydraulically set.

Preferably, the isolation arrangement comprises a burst disc.

Conveniently, the bridge plug may be set by rotation of the drill string.

Advantageously, the bridge plug is adapted to receive a signal sent from the surface, and to set itself in response to the signal.

Preferably, the signal is an electrical signal.

Conveniently, the signal is an acoustic signal.

Advantageously, the anchor and plug member each have an upper and lower end so that, when they are incorporated in a drill string in normal use, the lower ends thereof are entered into the wellbore first, and wherein the predetermined orientation is that the top end of the plug member contacts the bottom end of the anchor.

Preferably, the drill string further comprises a whipstock.

Conveniently, the apparatus further comprises a releasable connection between the bridge plug and at least one further component of the drill string.

Advantageously, the drill string has a fluid path passing at least a part of the way therealong, and the drill string further comprises a valve component which allows selective communication between the fluid path, being configured to allow fluid in the wellbore to enter the fluid path through the valve component, but preventing fluid in the fluid path from flowing out of the valve component to the wellbore.

Another aspect of the present invention provides a method for setting an anchor in a wellbore and milling a window in a side surface of the wellbore in a single trip, comprising the steps of: running a drill string into a wellbore, the drill string comprising a milling assembly, a mechanically-settable anchor and a plug member, and when the anchor is at an appropriate depth in the wellbore, setting the plug member in position with respect to the wellbore; detaching the anchor from the plug member; setting the anchor through interaction between the anchor and the bridge plug; and milling a window in a side surface of the wellbore using the milling assembly.

Preferably, the method further comprises the step, once the plug member has been set in position, of moving the drill string so that the plug member interacts with the anchor, thus mechanically setting the anchor.

Conveniently, the plug member is hydraulically-settable, the drill string has a fluid flow path that allows fluid to be delivered to the plug member, and the step of setting the plug member comprises increasing the pressure of fluid in the flow path to set the plug member hydraulically.

Advantageously, the plug member may be set by rotation of the drill string.

Preferably, the plug member is adapted to receive a signal sent from the surface, and to set itself in response to the signal, and wherein the method further comprises the step of sending a signal to the plug member from the surface to set the plug member.

Conveniently, the signal is an electrical signal.

Advantageously, the signal is an acoustic signal.

Preferably, the drill string further comprises an MWD tool, and wherein the method further comprises the step of using the MWD tool to determine the orientation of the drill string.

Conveniently, the step of using the MWD tool to determine the orientation of the drill string occurs after the bridge plug has been set.

Advantageously, the drill string further comprises a whipstock, and wherein the orientation of the whipstock is determined using the MWD tool.

Preferably, following the orientation of the whipstock using the MWD tool, the whipstock is supported by the anchor during the milling operation.

A further aspect of the present invention provides a tool for use in a drill string for subsurface drilling, the drill string having a fluid path passing at least part of the way therealong, the tool comprising: an inlet port and an outlet port, and a conduit passing therebetween, so that the conduit may form part of the fluid path of the drill string when the tool is incorporated into the drill string; a communication port extending between the fluid path and the exterior of the tool; and a valve element associated with the communication port, the valve element allowing fluid to enter the communication port, so that fluid may flow into the fluid path from the exterior of the tool, but preventing fluid from exiting the communication port, so that fluid may not flow out to the exterior of the tool from the fluid path.

Conveniently, the valve element is a one-way valve element.

Another aspect of the present invention provides an apparatus for setting an anchor mechanically in a borehole in a single trip, comprising: a mechanically-settable anchor; and a plug member position below the anchor, wherein: when the plug member reaches a desired depth in the wellbore, the plug member may be activated from the surface, thus setting the plug member in position with respect to the wellbore; the anchor has an activation element which, when contacted in a predetermined manner, sets the anchor; and the plug member has an operation element adapted so that, when the anchor and plug member come into contact with one another in a predetermined orientation, the activation element is operated by the operation element, thus setting the anchor.

In order that the present invention may be more readily understood, embodiments thereof will now be described, by way of example, with reference to the accompanying drawings, in which:

FIGS. 1 and 2 show components of a drill string suitable for use with the present invention; and FIGS. 3*a* to 3*d* show stages of use of the drill string of FIG. 1.

Referring to FIGS. 1 and 2, a drill string suitable for use for the present invention is shown. FIG. 2 shows the same components as FIG. 1, but in greater detail. The drill string is adapted to be run into a wellbore, which is reinforced by a casing which covers the interior surfaces of the bore. The casing may be made from, for example, steel.

At the upper end of the drill string, a heavyweight drill pipe (HWDP) 1 is provided, to provide sufficient weight for setting and milling operations. One or more drill collars may also be provided to orient the drill string appropriately with respect to the wellbore.

The HWDP 1 is connected to a drill pipe 2, which extends to the surface and into which drilling fluid may be pumped.

Connected to the lower end of the HWDP 1 is a MWD tool 3. As discussed above, an MWD tool may provide information regarding, for example, the orientation of the tool within the wellbore. In order for the MWD tool 3 to operate, drilling fluid must circulate through the MWD tool 3.

As will be known in the art, the MWD tool 3 may communicate with the surface in several ways, for instance via mud pulse telemetry, in which pulses in the drilling fluid are generated by the MWD tool 3. These may be positive pulses (of increased pressure), negative pulses (of decreased pressure) or continuous (comprising phase variations in a sinusoidal wave). These pulses may be detected at the surface, and decoded appropriately by pressure transducers. Alternatively, an MWD tool may communicate with the surface using electrical signals, and for this to be possible conductive elements must be provided in all of the components of the drill string above the MWD tool.

As will be appreciated by those skilled in the art, an MWD tool will not be able to determine the orientation of a drill string if the angle of inclination of the wellbore is less than 3°. If the wellbore is too close to being vertical, therefore, the orientation of the drill string may be determined using a UBHO (universal bore hole orientation) tool, in combination with one or more gyroscopes. A skilled person will appreciate how the system disclosed herein can be adapted so that a UBHO tool is used instead of a MWD tool.

Connected to the lower end of the MWD tool 3 is a spacer sub 4, which is relatively narrow and inserted to isolate any cavitation or flow disturbance from the MWD tool 3.

Connected to the lower end of the spacer sub 4 is a fill up sub 5. The fill up sub 5 allows an inflow of fluid from the wellbore into the drill string, to keep fluid levels equalised.

The fill up sub 5 contains a one-way valve, so that fluid within the wellbore can enter the drill string, but pressurised fluid flowing through the drill string is not allowed to exit to the wellbore directly at this point. The valve may comprise, for example, a floating ball arrangement, a poppet valve, or a flapper valve.

Use of a fill up sub 5 as described above means that the drill string can be filled with drilling fluid which is pumped from the surface, or filled with fluid from the wellbore, as the as the drill string is lowered into the wellbore for use.

Inserted into the lower end of the fill up sub 5 is flex joint 6, which allows the drill string to flex, for instance to negotiate changes in the direction of the wellbore. Attached to the lower end of the flex joint 6 is a running tool 7. As will be known to those skilled in the art, the running tool 7 provides a fluid barrier in the drill string, one purpose of which is to isolate the "dirty" drilling fluid circulated through the MWD tool 3 from "clean" fluid in the wellbore below the running tool 7. The running tool 7 includes a piston which, if the pressure in the fluid in the drill string above the running tool 7 is increased (while remaining below a certain threshold), transmits the increases so that the pressure in the fluid below the running tool 7 increases correspondingly. When the pressure is increased above the threshold, the piston moves into a bypass position that allows the flow of fluid through the running tool 7. When the piston moves to the bypass position, a hose or other communicating pipework may be fractured, or a burst disc may be ruptured, so that the displacement of the piston is completed and a flow path through the running tool is established. A skilled person will realise that several different designs of running tool may be used.

Attached to the lower end of the running tool 7 is a milling assembly 8, which includes a milling head 9. The milling head 9 may be of any design. As will be understood by those skilled in the art, the milling assembly 8 will be used to mill the window in the casing of the wellbore, and may also be used to mill a starter portion, or more, of the new bore that is to be formed branching off from the wellbore.

Provided below the milling assembly 8 in the drill string is a whipstock 10. The whipstock 10 is connected to the milling assembly 8 by a releasable connection, for instance comprising one or more shear bolts. As will be understood by those skilled in the art, the whipstock 10 is narrow at its top end 11 and has a tapered guide face 12, so that the cross-sectional area of the whipstock 10 increases gradually along its length until, at its bottom end 13, the whipstock 10 substantially fills the wellbore.

If the whipstock 10 is held in place and the milling assembly is driven downwardly with respect to the whipstock 10, the milling head 9 will be progressively forced against one side of the wellbore casing by the tapered guide face 12 of the whipstock 10, and will therefore mill a window into the casing opposite the guide face 12. Once the milling head 9 moves past the guide face 12, the milling head 9 will be entirely within the formation around the well bore, and will start to drill the new, separate bore, known as a sidetrack.

Connected to the lower end of the whipstock 10, preferably by a flexible joint such as a hinge pin 14, is an anchor 15. The anchor 15 is a mechanically-set anchor, and hence is triggered by mechanical means, rather than being hydraulically-set. The skilled person will understand that one or more protrusions, known as "slips" may extend outwardly from the anchor 15 when it is activated to hold the anchor is firmly against the casing of the wellbore. In the pre-activation state the slips are held substantially within the body of the anchor 15, but are biased outwardly by one or more springs, cones and/or tapers (not shown). When the anchor 15 is activated, the slips are released and are driven outwardly by the springs, cones and/or tapers.

In certain embodiments of the invention, the anchor is a "single grip" anchor, in which the slips are angled downwards. When a single grip anchor is initially activated, the slips are pressed outwardly against the casing, and will not substantially resist the anchor being pulled upwardly through the bore. However, if significant downward force is applied to the anchor, the slips will dig into the casing, very strongly resisting downward motion of the anchor, and the anchor is then "set" in position.

In alternative embodiments, the anchor may be a "double grip" anchor, having bi-directional slips which will resist either upward or downward motion of the anchor once it has been activated.

Finally, beneath the anchor 15, a plug member, in the form of a bridge plug 16, is provided. The bridge plug 16 is attached to the underside of the anchor 15 by a release means 17, which preferably comprises one or more shear bolts or pins, or alternatively a releasable latch arrangement.

The bridge plug 16 is also arranged, when activated, to grip against the casing of the wellbore, and hold itself in position, by means of one or more slips which are initially held substantially within the body of a bridge plug 16, but protrude outwardly when the bridge plug 16 is activated.

In preferred embodiments of the invention, the bridge plug 16 is hydraulically actuated, and includes an input port into which fluid can be introduced. When fluid is introduced through the port at a sufficiently high pressure, the bridge plug 16 will be activated. The pressure required to set the bridge plug 16 is less than that required to rupture the burst disc.

A fluid path is formed through the drill string. Fluid may be pumped into the drill string from the top end by operators at the surface, and may pass through the running tool 7, and all of the components above the running tool 7, to the milling assembly. Preferably, the milling head 9, or another part of the milling assembly 8, is provided with a number of fluid circulation ports (an exemplary one of which is shown at 8*a* in FIG. 2), which allow fluid to be pumped out of the milling head 9 to the annulus (i.e. the space within the wellbore surrounding the drill string) during drilling. Preferably, an isolation arrangement is provided to isolate the circulation ports from the fluid path of the drill string in an initial configuration. For instance, a rupturable element such as a burst disc may be provided between the main fluid path and the circulation ports, with the burst disc being adapted to rupture when the fluid flow rate through the fluid path exceeds a preset level.

A bypass conduit (not shown) allows fluid in the drill string to flow past the burst disc, through the whipstock 10 and anchor 15, to the bridge plug 16. An example of a burst disc and bypass conduit of this type is shown in WO2006/070204.

As an alternative, one or more plugs (known as "knock-off plugs") may be used to isolate the circulation ports, as will be understood by those skilled in the art.

Use of the system will now be described.

Initially, the drill string is run into a wellbore, and the drill string is filled with fluid as required during this process. When the whipstock 10 is at an appropriate depth, the drill string is held in position and fluid pumping equipment surface is connected to the drill string. The initial configuration of the drill string is shown in FIG. 3*a*.

Fluid is then pumped through the drill string at a pressure which is sufficient to set the bridge plug 16, but which is not sufficient to rupture the burst disc. The bridge plug 16 is therefore held in position with respect to the wellbore. An upward or downward force is then applied to the drill string to break the shear bolts of the shear release means 17, or release the latch, thus separating the bridge plug 16 from the remaining components of the drill string, as shown in FIG. 3*b*.

Alternatively, the bridge plug 16 may configured so that, when it is set, it releases itself from the remaining components of the drill string. For instance, one or more connecting pins may be moved to as to disengage from appropriate apertures, with this disengaging motion being linked to the outward motion of the slips.

The drill string may then be raised so that the anchor 15 is separated above the bridge plug 16, and the fluid pressure in the drill string is then increased to a level sufficient to rupture the burst disc. Fluid in the drill string is then in communication with the circulation ports of the milling head 9, and fluid may then be circulated through the drill string and wellbore at a flow rate sufficient to allow the MWD tool 3 to operate, and communicate its orientation to operators at the surface.

Using the information obtained from the MWD tool 3 the whipstock 10 can be oriented appropriately within the wellbore (the orientation of the whipstock 10 with respect to MWD tool 3 will be known).

When the whipstock 10 is in the correct orientation within the wellbore, the drill string is driven downwardly so that the bottom of the anchor 15 contacts the top of the bridge plug 16. The anchor 15 is configured so that it can be activated mechanically by an appropriate force applied to the bottom thereof. For instance, an activation element 15*a* (FIG. 2) may be presented on the bottom of the anchor 15 which, when pushed inwardly, releases the slips, allowing the slips to be driven outwardly by the springs. The anchor 15 is then set in position, and it will be appreciated that this approach is particularly appropriate if the anchor 15 is double grip.

The bridge plug 16 is appropriately shaped to have an operation element 16*a* so that when the top of the bridge plug 16 comes into contact with the bottom end of the anchor 15, the operation element of the bridge plug 16 contacts the activation element, causing the anchor 15 to be set, as shown in FIG. 3*c*.

Alternatively, particularly in embodiments where the anchor 15 is single grip, the anchor 15 may be set automatically when it is disengaged from the bridge plug 16. The anchor 15 may still then be pulled upwardly through the wellbore, and rotated within the wellbore, until the depth and orientation of the anchor 15 are as required. A downward force is then applied to the drill string to dig the slips of the anchor 15 into the casing, setting the anchor 15 in position within the wellbore.

Once the anchor 15 has been set in position, an upward or downward force may be applied to the drill string to break the connection between the whipstock 10 and the anchor 15, as shown in FIG. 3*d*. Rotation of the milling head 9 can then be commenced, and downward force can be applied to the drill string to begin the main milling operation.

Once the desired window has been milled in the casing of the borehole, the drill string may be pulled back up to the surface. In preferred embodiments of the invention, the whipstock 10, the anchor 15 and the bridge plug 16 are configured to be retrievable, so that they can be recovered from the borehole at the end of the milling operation. A skilled person will appreciate how this may be achieved. For instance, in embodiments where the anchor 15 has a depending activation element or "stinger" at the bottom end thereof, the activation element may be received and retained within a bore of the bridge plug 16 following setting of the anchor 15 so that, when the anchor 15 is recovered to the surface, the anchor 15 pulls the bridge plug 16 upwards so that the bridge plug 16 is simultaneously withdrawn from the wellbore. This system will be particularly effective where the bridge plug 16 is adapted to release its grip on the casing when an upward force is applied thereto in this manner.

In alternative embodiments, one or both of the anchor 15 and the bridge plug 16 may be left in the wellbore when the milling arrangement 8 is withdrawn, and may be recovered in a subsequent trip.

In the arrangement described above, the bridge plug is described as being hydraulically-settable. However, this is not essential, and the bridge plug may be settable by any suitable means. For instance, the bridge plug may be rotatably settable, so that appropriate rotation of the drill string will set the bridge plug in position within the wellbore. It is anticipated that in such embodiments a body of the bridge plug will be frictionally engaged with the casing, and so rotation of the drill string will cause relative rotation within the bridge plug, which may release the slips, or lock the slips in position.

In further embodiments, the bridge plug may be set by one or more explosive charges or squibs, activated by a signal received from the surface. The signal may be received electrically, for instance through a conductor or series of conductors that pass through the drill string. Alternatively, an acoustic signalling method may be used, with compression pulses being emitted through fluid in the wellbore from the surface, as described above in relation to mud pulse telemetry. Acoustic pulses may alternatively be transmitted through the drill string itself, the wellbore casing or the fluid in the drill string. In preferred embodiments, one or more repeater stations may be provided along the length of the drill string, to detect and re-emit the pulses to maintain the integrity of the signal.

It will be appreciated that the order of the components in the drill string may vary from that set out above.

It will be appreciated that embodiments of the present invention will confer advantages over known arrangements.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An apparatus for setting an anchor in a borehole and milling a window in a side surface of the borehole in a single trip, comprising:

a drill string;

a mechanically-settable anchor initially forming part of the drill string;

a plug member positioned below the anchor and releasably attached to the drill string; and a milling assembly; wherein:

as the drill string reaches a desired depth in the wellbore, the plug member is activated from the surface, thus setting the plug member in position with respect to the wellbore;

the anchor has an activation element which, as the activation element is contacted in a predetermined manner, sets the anchor; and the plug member has an operation element adapted so that, as the anchor and plug member come into contact with one another in a predetermined orientation, the activation element is operated by the operation element, thus setting the anchor.

2. The apparatus according to claim 1, wherein the plug member is hydraulically-settable.

3. The apparatus according to claim 2, wherein:

the drill string has a fluid path passing at least part of the way therealong;

the plug member is in communication with the fluid path; and fluid may be pumped through the drill string to the plug member to activate the plug member.

4. The apparatus according to claim 2, wherein the drill string further comprises:

a measurement while drilling (MWD) tool; and a running tool which prevents fluid flow therethrough until the pressure in the fluid path exceeds a threshold, and wherein:

the pressure required to set the plug member hydraulically is less than the threshold; and when the pressure in the fluid path exceeds the threshold, the running tool allows fluid to pass therethrough, thus allowing fluid to circulate through the MWD tool.

5. The apparatus according to claim 1, wherein the plug member is set by rotation of the drill string.

6. The apparatus according claim 1, wherein the plug member is adapted to receive a signal sent from the surface, and to be set in response to the signal.

7. The apparatus according to claim 6, wherein the signal is an electrical signal or an acoustic signal.

8. The apparatus according to claim 1 wherein the anchor and plug member each have an upper and lower end so that, when incorporated in a drill string in normal use, the lower ends of the anchor and plug member are entered into the wellbore first, and wherein the predetermined orientation is that the top end of the plug member contacts the bottom end of the anchor.

9. The method according to claim 8, wherein the plug member is set by rotation of the drill string.

10. The method according to claim 8, wherein the plug member is adapted to receive a signal sent from the surface, and to be set in response to the signal, and wherein the method further comprises the step of sending a signal to the plug member from the surface to set the plug member.

11. The method according to claim 8 wherein the drill string further comprises an MWD tool, and wherein the method further comprises the step of using the MWD tool to determine the orientation of the drill string.

12. The method according to claim 11, wherein the step of using the MWD tool to determine the orientation of the drill string occurs after the plug member has been set.

13. The method according to claim 12 wherein, following the orientation of the whipstock using the MWD tool, the whipstock is supported by the anchor during the milling operation.

14. The apparatus according to claim 1, wherein the drill string has a fluid path passing at least a part of the way therealong, and the drill string further comprises a valve component which allows selective communication between the fluid path, being configured to allow fluid in the wellbore to enter the fluid path through the valve component, but preventing fluid in the fluid path from flowing out of the valve component to the wellbore.

15. An apparatus for setting an anchor in a borehole and milling a window in a side surface of the borehole in a single trip, comprising:

a drill string;

a mechanically-settable anchor initially forming part of the drill string;

a hydraulically-settable plug member positioned below the anchor and releasable attached to the drill string; and a milling assembly; wherein:

as the drill string reaches a desired depth in the wellbore, the plug member is may be activated from the surface, thus setting the plug member in position with respect to the wellbore;

the anchor has an activation element which, as the activation element is contacted in a predetermined manner, sets the anchor;

the plug member has an operation element adapted so that, as the anchor and plug member come into contact with one another in a predetermined orientation, the activation element is operated by the operation element, thus setting the anchor; and at least one circulation port provided on a component of the drill string, and wherein the circulation port is isolated from the fluid path until after the plug member has been hydraulically set.

16. A method for setting an anchor in a wellbore and milling a window in a side surface of the wellbore in a single trip, comprising the steps of:

running a drill string into a wellbore, the drill string comprising a milling assembly, a mechanically-settable anchor and a plug member, and as the anchor is at an appropriate depth in the wellbore, setting the plug member in position with respect to the wellbore;

detaching the anchor from the plug member;

setting the anchor through interaction between the anchor and the plug member; and milling a window in a side surface of the wellbore using the milling assembly.

17. The method according to claim 16, further comprising the step, once the plug member has been set in position, of moving the drill string so that the plug member interacts with the anchor, thus mechanically setting the anchor.

18. The method according to claim 16, wherein:

the plug member is hydraulically-settable;

the drill string has a fluid flow path that allows fluid to be delivered to the plug member; and the step of setting the plug member comprises increasing the pressure of fluid in the flow path to set the plug member hydraulically.

19. The method according to claim 16, wherein the signal is an electrical signal or an acoustic signal.

20. An apparatus for setting an anchor mechanically in a borehole in a single trip, comprising:

a mechanically-settable anchor; and a plug member positioned below the anchor and releasable attached to the anchor, wherein:

as the plug member reaches a desired depth in the wellbore, the plug member is activated from the surface, thus setting the plug member in position with respect to the wellbore;

the anchor has an activation element which, as the activation element is contacted in a predetermined manner, sets the anchor; and the plug member has an operation element adapted so that, as the anchor and plug member come into contact with one another in a predetermined orientation, the activation element is operated by the operation element, thus setting the anchor.

* * * * *